United States Patent [19]

Lyons

[11] Patent Number: 4,520,936

[45] Date of Patent: Jun. 4, 1985

[54] BLOW MOULDED PLASTIC CONTAINERS

[75] Inventor: Gerard E. Lyons, Burlington, Canada

[73] Assignee: Polybottle, Weston, Canada

[21] Appl. No.: 380,455

[22] Filed: May 20, 1982

[51] Int. Cl.[3] ..... B65D 1/02; B65D 23/00

[52] U.S. Cl. ..... 215/1 C; 220/70

[58] Field of Search ..... 215/1 C; 206/503; 220/69, 70

[56] References Cited

U.S. PATENT DOCUMENTS

| | | | |
|---|---|---|---|
| 2,936,920 | 5/1960 | Wallace | 220/70 X |
| 3,043,461 | 7/1962 | Glassco | 215/1 C |
| 3,225,950 | 12/1965 | Josephsen et al. | 215/1 C |
| 3,598,270 | 8/1971 | Adomaitis | 215/1 C |
| 3,727,783 | 4/1973 | Carmichael | 215/1 C |
| 4,301,933 | 11/1981 | Yoshino | 220/70 X |
| 4,308,955 | 1/1982 | Schieser et al. | 215/1 C X |

FOREIGN PATENT DOCUMENTS

| | | | |
|---|---|---|---|
| 2449045 | 10/1980 | France | 215/1 C |

*Primary Examiner*—William Price
*Assistant Examiner*—Sue A. Weaver
*Attorney, Agent, or Firm*—Rogers, Bereskin & Parr

[57] ABSTRACT

A blow moulded plastic container is disclosed. The container has a base with a raised central portion and a marginal portion surrounding the raised central portion. The marginal portion includes at least three spaced supporting sections adapted to support the container on a surface in use. Intervening areas of the marginal portion between the supporting sections are depressed inwardly of the container with respect to said sections, which makes for improved flow of the plastic material during moulding and results in a stronger container.

5 Claims, 3 Drawing Figures

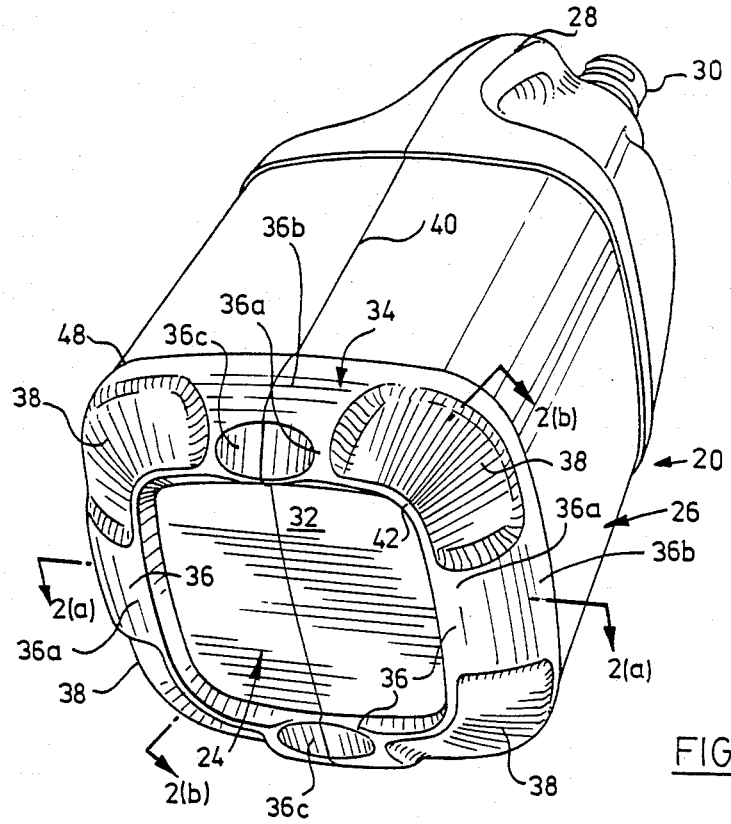
FIG.1
FIG.2
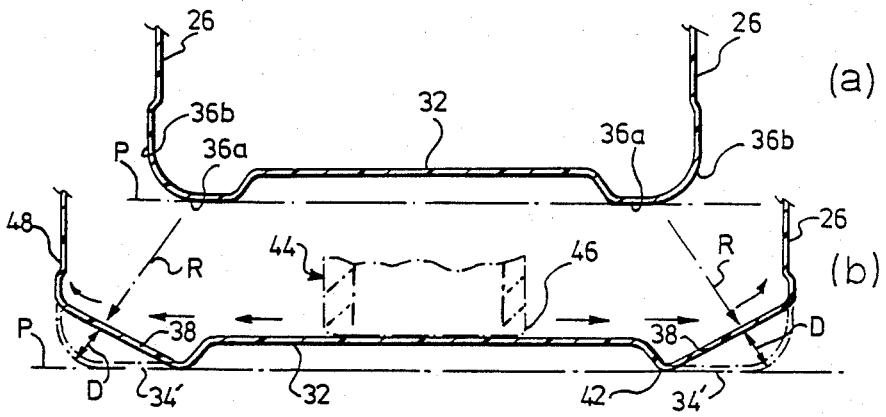

BLOW MOULDED PLASTIC CONTAINERS

This invention relates generally to blow moulded plastic containers.

Blow moulding is a well-known technique used for manufacturing hollow plastic articles such as bottles or other containers. Typically, a tube or "parison" of plastic material in a hot mouldable condition is positioned between two halves of a partible mould having a mould cavity of a shape appropriate to the required external shape of the article to be moulded. The mould halves are closed around the parison and pressurized air is introduced into the interior of the parison to cause it to expand and conform to the shape of the mould cavity. The mould cools the plastic material to its final rigid shape and the mould is then opened and the article removed.

When the article is a bottle or other container having a base at its lower end, the parison is closed or "pinched off" by the mould parts at the bottom of the mould cavity. When air is introduced into the parison, the plastic material immediately above the pinched off area flows outwardly along the bottom of the mould cavity and forms the base of the container. Typically, the bottom of the mould cavity is concavely contoured around its perimeter, so that the container base is correspondingly contoured convexly around its perimeter.

It will be appreciated that the plastic material which forms these contoured areas must flow outwardly over a relatively long distance depending on the diameter of the container. As a result, it is difficult to accurately control the thickness of these areas of the container wall and in practice, unacceptably thin zones often occur in these areas. Where the container is of square or other rectangular shape in plan, this problem is accentuated in the lower "corner" areas of the container because the material for forming these areas must flow outwardly from the parison even further than the material which forms the contoured areas between the corners.

As a result of these difficulties, the contoured areas between the base and the side wall of a blow moulded container are usually the weakest part of the container. If the container is accidentally dropped in service, it will often fall on one of these areas, which may well cause the container wall to rupture. The risk of this happening is particularly acute in the case of large volume containers for liquids (e.g. four liters capacity), where the weight of the liquid is significant and its inertia results in severe stresses being imposed on the container wall when the container falls on a solid surface.

Techniques have previously been proposed for varying the wall thickness of the parison in an attempt to provide a greater thickness of material in these weak areas of the container wall. However, these techniques have largely proven difficult to control accurately. Conventionally, therefore, the practice has been to make the radius between the base and the side wall of the container as large as possible in an attempt to encourage the plastic material to flow smoothly around these areas of the mould and minimize the risk of thinning of the container wall. However, if too large a radius is adopted, the container will be unstable.

An object of the present invention is to provide an improvement in blow moulded plastic containers intended to minimize this problem.

According to the invention there is provided a blow moulded plastic container having a base adapted to support the container on a surface, and a side wall which extends upwardly from the base and defines therewith, a space within the container. The base is of substantially uniform wall thickness throughout and includes a central portion which is raised with respect to a plane in which the base makes contact with a said surface, and a marginal portion surrounding the raised central portion. The marginal portion includes at least three supporting sections spaced around the portion and adapted to support the container on a support surface in use. The sections have respective outer surfaces which are disposed in said plane at the lower extremity of the container and which curve convexly upwardly from said plane and merge into the side wall of the container. Intervening areas of the marginal portion of the base between the supporting section are depressed inwardly of the container with respect to said sections.

The invention is of particular significance where the container is of square or other rectangular shape in plan. As indicated above, containers of this form are particularly susceptible to weaknesses in the contoured areas between the base and the side wall of the container. Where the container is of rectangular shape, four supporting sections will typically be provided in the base and will be disposed one substantially midway along the length of each side of the base, with the said intervening areas at the corners of the base.

In order that the invention may be more clearly understood, reference will now be made to the accompanying drawings which illusttrate a preferred embodiment of the invention by way of example, and in which:

FIG. 1 is a perspective view from below of a container according to the invention; and, FIGS. 2(*a*) and 2(*b*) are vertical sectional views along the correspondingly designated section lines in FIG. 1.

Referring first to FIG. 1, the container itself is generally indicated by reference numeral 20 and has a base 24 by which the container can be supported on a surface, and a side wall 26. The side wall extends upwardly from the base and defines therewith a space within the container for receiving a material to be contained. In this particular embodiment, the container is of a form such as might be typically used for containing household liquids such as bleach or detergent although this is not directly relevant to the invention. The container has a carrying handle denoted 28 and a neck 30 which is externally screw-threaded to receive a closure cap.

The container illustrated is of generally square shape in plan and its base 24 is correspondingly shaped. The base includes a raised central portion 32 which is raised with respect to a plane in which the base makes contact with a surface and a marginal portion 34 which surrounds portion 32.

In FIGS. 2(*a*) and (*b*) reference character P denotes a plane in which the base makes contact with a surface on which the container is supported. Central portion 32 is raised with respect to that plane. The marginal portion 34 includes four supporting sections 36 which are spaced around the marginal portion 34 of the base and which are adapted to support the container on a surface in use. It will be noted that, in this case, each of the sections 36 is disposed substantially centrally along a side of the base 24 (see FIG. 1). Intervening areas of the marginal portion of the base are denoted 38 and are disposed at the corners of the base.

FIG. 2(*a*) is a diametral sectional view through an opposed pair of the supporting sections 36 and it will be seen that the sections have respective outer surfaces 36*a* which are disposed in plane P at the lower extremity of the container and which curve convexly upwardly from the plane as indicated at 36*b* and merge into the side wall 26 of the container. These surfaces are substantially flat in plane P so that the container is supported in stable fashion on the support surface. In FIG. 1, it will be noted that the two supporting sections 36 which appear respectively at the top and bottom of the base as shown both include dimples or depressions 36*c* so that the lower surfaces 36*a* of those two sections are not completely flat at the bottom. This is done in accordance with normal moulding practice because those two sections lie in a plane in which the two mould halves meet when the container is being moulded. Typically, an almost imperceptible line indicated at 40 in FIG. 1 will appear on the container at the position of this plane. Excess plastic material called "flash" often remains on the surface of the article at the position of this line, and the depressions 36*c* are provided to accommodate this excess material, which might otherwise tend to prevent the container sitting flat on the support surface.

In this embodiment, the raised central portion 32 of the base of the container is surrounded by a ridge 42 which joins the four supporting sections 36 and assists in providing stable support for the container.

The four intervening areas 38 of the marginal portion 34 of the base are depressed inwardly of the container with respect to the sections 36 as can best be seen in FIGS. 1 and 2(*b*). Since these areas take no part in supporting the container, they can be contoured in a manner considered most appropriate to the promotion of smooth plastic flow during moulding and uniform container wall thickness. As indicated above, this is believed to be best achieved by providing a large radius on these areas. Thus, as considered in cross-section (FIG. 2(*b*)) the areas extend in an arc of substantial radius (indicated at R) centered on an axis parallel to and above plane P and disposed on a line coincident with the centreline of the container. In the illustrated embodiment, the depressed portions 38 in fact have an almost infinitely large radius and are substantially flat in section as shown in FIG. 2(*b*) and are inclined upwardly from ridge 42 towards the container side wall. The areas are of somewhat rounded rectangular shape and essentially "wrap around" the corners of the marginal portion of the base.

In FIG. 2(*b*) a tubular parison such as that from which the container would be formed is shown sectioned and in ghost outline at 44. When the parison is inflated by internal air pressure, the plastic material of the parison is caused to flow outwardly as indicated by the arrows. Portions of the parison above the pinched off area indicated by reference numeral 46 form the base 24, including the marginal portion 34. In FIG. 2(*b*) the marginal portion is shown in ghost outline at 34' in the configuration it would adopt in a conventional container while the full lines denoted 38 show the shape of the recessed areas in accordance with the invention. It will be seen that, in the conventional container, the plastic material must be caused to flow an additional distance represented by the arrows denoted D. In practice it is found that by reducing this distance in the manner contemplated by the invention, improved flow characteristics and uniformity of wall thickness can be achieved as compared with conventional containers. At the same time, the supporting sections 36 ensure that the container is stable.

The invention is believed to be of particular significance where the container is of square shape in plan because conventional containers of this shape are particularly susceptible to weaknesses in the lower "corners". In the container provided by the invention the "corner" areas of the base are recessed and can be made of large radius as described above, which reduces the possibility of weakness. Also, the supporting sections 36 are disposed so that the plastic material from which these areas are formed is required to flow a minimum distance (commensurate with the diameter of the container) from the parison during moulding, which minimizes the risk of weakness in these sections.

In the illustrated embodiment, the container has the additional advantage that multiple contour changes are incorporated in the profile of the base, providing additional strength. Not only is there a contour change between the central portion 32 of the base and the marginal portion, but contour changes are also provided by virtue of the presence of the depressed areas 38 and between the marginal portion 34 of the base and the side wall 26 of the container at ridge 48.

It will of course be appreciated that the preceding description relates to a particular preferred embodiment of the invention and that many modifications are possible within the broad scope of the invention. Some of those modifications have been indicated above and others will be apparent to a person skilled in the art. For example, while the invention has been defined in reference to a container in the form of a bottle there is no limitation to this particular article. For example, the container could be open topped or of some other shape above the base.

I claim:

1. A blow moulded plastic container which is of substantially rectangular shape in plan and which has a correspondingly shaped base adapted to support the container on a surface, and a side wall which extends upwardly from the base and defines therewith a space within the container, wherein the base is of substantially uniform wall thickness throughout and includes a central portion which is raised with respect to a plane in which the base makes contact with a said surface and a marginal portion surrounding said raised central portion, said marginal portion including four supporting sections spaced around said portion, said supporting sections being positioned essentially mid-way along each side of the base and being adapted to support the container on a said surface in use, said sections having respective outer surfaces which are disposed in said plane at the lower extremity of the container and which curve convexly upwardly from said plane and merge into the side wall of the container, intervening areas of said marginal portion between said supporting sections being depressed inwardly of the container with respect to said supporting sections and extending around corners of said marginal portion of the base.

2. A container as clained in claim 1, wherein said intervening areas, as considered in cross-section, extend in an arc of substantial radius centered on an axis parallel to and above said plane and disposed on a line coincident with the centre line of the container.

3. A container as claimed in claim 2, wherein said raised central portion of the base is surrounded by a ridge, and wherein each said intervening area is substantially flat in cross-section and is inclined upwardly and outwardly from said ridge towards said container side wall.

4. A container as claimed in claim 1, wherein two opposed ones of said supporting sections are disposed in a common diametral plane of the container containing a mould part line, and wherein said outer surfaces of those sections are provided with depressions in said plane or accommodating excess plastic material produced during moulding of the container.

5. A container as claimed in claim 1, wherein said marginal portion of the base merges into the side wall of the container at a ridge which encircles the container and defines a contour change in the external surface of the container.

* * * * *